United States Patent [19]

Christian

[11] Patent Number: 4,819,792

[45] Date of Patent: Apr. 11, 1989

[54] FOLDING DISPLAY

[76] Inventor: George T. Christian, 3112 Moore St., San Diego, Calif. 92110

[21] Appl. No.: 3,377

[22] Filed: Jan. 13, 1987

Related U.S. Application Data

[63] Continuation of Ser. No. 825,529, Feb. 3, 1986, abandoned.

[51] Int. Cl.[4] ..... B65D 5/50

[52] U.S. Cl. ..... 206/45.25; 206/45.18; 220/6

[58] Field of Search ..... 206/45.25, 45.26, 45.18, 206/45.31, 45.33; 220/6

[56] References Cited

U.S. PATENT DOCUMENTS 1,367,048 2/1921 Horr ..... 206/45.25

2,532,216 12/1950 Williamson ..... 206/45.25

3,185,294 5/1965 Lustman ..... 206/45.25

3,744,623 7/1973 Wootter ..... 220/6

*Primary Examiner*—Joseph Man-Fu Moy

*Attorney, Agent, or Firm*—Ralph S. Branscomb

[57] ABSTRACT

A counter or wall display for cards or brochures is made from a single stamping which is die-cut to define both the perimeter of the unit and at the same time stamp score lines partially through the material to define the hinge lines. The score lines divide the single sheet into connected front, floor and rear panels, and a pair of side panels which hinge rearwardly from the front panel and have edges which interlock with the edges of the rear panel, so that an open-topped box display is formed from a single sheet of planar stock with no fasteners whatsoever.

1 Claim, 1 Drawing Sheet

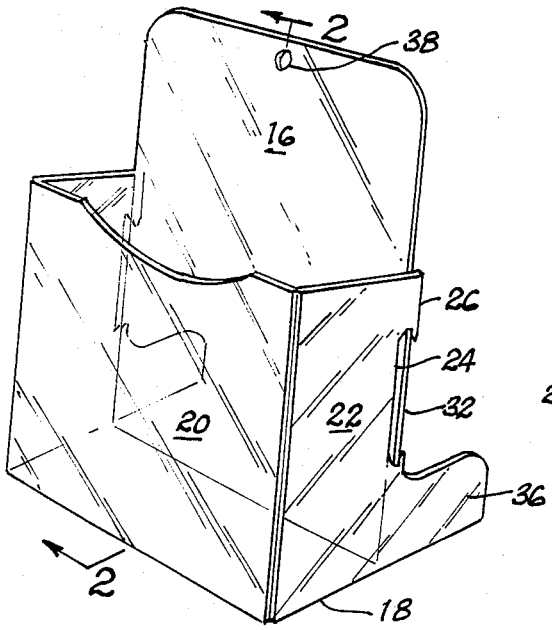
FIG. 1
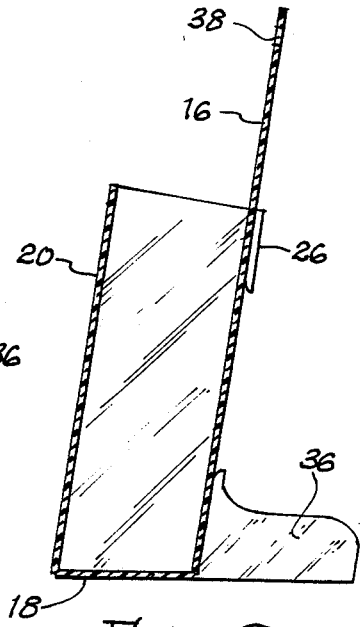
FIG. 2
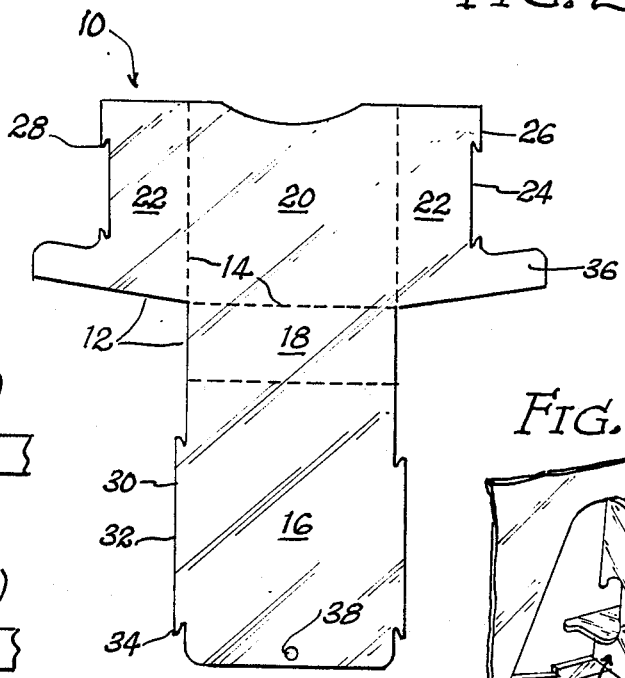
FIG. 3
FIG. 4(a)
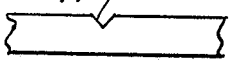
FIG. 4(b)
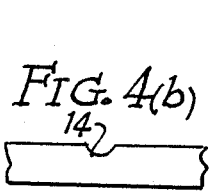
FIG. 5
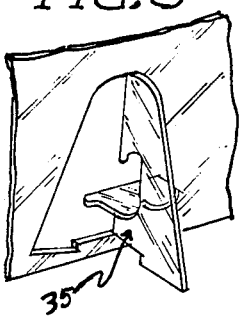

FOLDING DISPLAY

BACKGROUND OF THE INVENTION

This is a continuation of patent application Ser. No. 825,529, filed 02/03/86.

There is a virtually infinite variety of cards, flyers and brochures that are displayed on desktops and on walls, in both instances held up for display by little open-topped boxes, to permit an interested party to pull one of the flyers, etc., out. Typically these little boxes are molded from plastic. They may be partially or completely transparent, and they may or may not have advertising or other promotional or instructional indicia marked on the front or sides of the box. The instant invention is in the field of these display boxes, and in particular, the invention comprises a display superior to the molded plastic kind.

The molded display boxes described above are made in the hundreds of millions and can be seen everywhere commercial enterprise is evident. They are made the same way that any injection-molded plastic product is made, by first making a rather expensive mold from a production prototype, and then shooting the likely multi-cavity mold virtually endlessly to produce vast quantities of the box displays, so that the price of the mold is amortized over sufficient quantities of product to justify its production.

Once molded, the displays are boxed and shipped to their destination, and then in all liklihood at least some of them are stored for a period of time until needed. Even though the actual amount of material (i.e., plastic) in the product is rather small, because the units are molded and rigid, they of necessity occupy a large volume and thus require voluminous boxing, shipping space and storage space that is not justified by the actual mass of material, but is necessary because of the fact that the displays are molded and no way collapsible. Although this is less of a factor if the displays are so tapered that they nest neatly, nonetheless space requirements are exaggerated compared to the actual volume of the material itself that is involved.

There is a need, therefore, for an open-topped box-style display that is not molded, but is rather die-cit from flat stock to define a suitably shaped series of panels, interconnected through die-cut score lines acting as hinges, so that the displays can be boxed, shipped and stored as a flat stack, and then assembled quickly and easily at the point of use, without the use of any tools or fasteners.

SUMMARY OF THE INVENTION

The instant invention fulfills the above-stated need and comprises a box display that is made from a single stamping. The stamping is somewhat T-shaped in planform, the stem of the T defining the back panel of the display and having elongated recesses cut in the edges which act as detents on the respective sides of the rear panel. A die-cut score line functionally separates the rear panel from the connected floor panel, and another score line parallel to the first one defines the front panel, which swings up parallel to the rear panel.

The two arms of the T end up as side panes separated by scored hinges from the integral front panel, and the side panels have elongated lobes with ears which snap into the recesses defined by the rear panel, so that a box is formed which is substantially rigid and resistant to all forms of crushing, panel sliding, and twisting. The result is a box-type display having the same characteristics as its molded counterpart, but being made not from an expensive injection mold, but from a die, and which requires the minimum possible space for shipping and storing.

Because the display is flat until used, it can be sent singly or in small numbers in standard mailing envelopes rather than requiring shipping boxing, making it ideal for sending to numerous branch offices from a company's headquarters along with material to be displayed.

BRIEF DISCRIPTION OF THE DRAWINGS

FIG. 1 is a perspective view of the display in its assembled, ready-to-use mode;

FIG. 2 is a section taken through line 2—2 of FIG. 1;

FIG. 3 is a top planform view of the display folded out flat as it would appear after the die cut but before being assembled into the form illustrates in FIG. 1;

FIG. 4*a* is a sectional detail illustrating one form of die-cut score line in which the die leaves a v-shaped cut for the hinge line;

FIG. 4*b* is a view identical to that of FIG. 4*a* but in which a U-shaped die cutting edge was used; and, FIG. 5 is a perspective view of detail of a modification of the support structure showing a typical desk-calendar style collapsible suport.

DETAILED DESCRIPTION OF THE PREFERRED EMBODIMENT

The preferred form of the invention is shown in FIG. 1 completely assembled and ready for use. It is made from a single stamping, shown at 10 in FIG. 3. The stamping is cut cleanly around the perimeter 12, and along the lines that are to be hinge lines (or rather fold lines, as the panels are bent along these lines more than actually hinged), the stamping die makes a scoring cut shown at 14 in FIGS. 4*a* and 4*b*.

FIG. 4*a* illustrates a V-shaped scoring cut that would be made by the die, and FIG. 4*b* illustrates a more U-shaped cut that would be made by a slightly more expensive mold, but which would have better wearing characteristics.

In a fairly simple series of hand motions, the flat stamping of FIG. 3 can be folded and interlocked into the box-like configuration of FIG. 1. The stamping consists of a first panel 16, a floor panel 18, a second panel 20, and two side panels 22. In the illustrated embodiment, the panels 16 and 18 are the rear and front panels, respectively, although this could be reversed, such that the side panels extend from the rear panel rather than from the front panel. Each of the panels is defined by its outer perimeter, and each is separated from one or more adjoining panels by one of the score lines 14 so that the bend between panels is clean and neat. Right angles, or close to right angles, are defined where needed between the panels; the scoring, which cuts about one third of the way through the material, adequately weakens the material so that little bowing out occurs around the joints.

Each of the side panels defines an elongated recess 24 in each of its side edges 26, and these recesses each have a pair of opposed, inwardly directed ears 28 which act as detents, as will be shown.

Correspondingly, each of the side edges 30 of the panel 16 defines an elongated lobe 32 with outwardly directed ears 34. The lobes 32 act as locking means and snap into the recesses 34, which act as $etents, with the ears of the respective pieces interlocking as shown in FIG. 1. The lengths of the lobes and recesses are sufficient so that two widely spaced points of interlocking are provided for each of the attachment lines for a strong assembly that is not prone to twisting deformation under stress.

In order to interlock the lobes with the recesses, the lower ears are first interlocked, and then the panel 16 is bowed slightly at the lobe area such that the effective lengths of the lobes are reduced just enough to fit into the recesses, and when the panel is released, the lobes snap back flat, securely engaging the ears in tightly interlocking relationship.

The model shown in the drawings is raked back slightly, and to help support it on a flat surface a pair of feet 36 extend rearwardly from the side panels. These feet are optional, and could be replaced with the single, central foot of the type common in desk calendars indicated at 35 in FIG. 5 which can be made to bend out and stay there, or can be folded flat out of the way so that the unit can be wall-mounted, such as with mounting hole 38.

In order to make the detent and locking structure work right, the stock from which the display is cut should be somewhat resilient. There are many plastics that meet this criterion, and many paper and cardboard stocks as well, although it is intended that in its more general implementation plastic will be used, and often clear plastic. Silkscreening, printing, foil stamping, die-cut shapes and embossing can be done on any side of the display, even if very slick, high-gloss plastic is used.

Because it can be cut with an inexpensive mold, and shipped very efficiently in a flat stack or individually in an ordinary envelope, any yet assumes an almost-perfect box shape when assembled with wirtually imperceptible bowing, the display disclosed and claimed herein is superior in several ways to the currently used type which is molded as a completed unit, and should soon start replacing them in the marketplace.

I claim:

1. A folding display which is free-standing when folded, comprising:

(a) a first panel having first side edges and defining detent means at said side edges;

(b) a second panel having second side edges with side panels extending therefrom into contact with the detent mean of said first panel; and, (c) said side panels having locking means for engaging said detent means such that when said locking means and detent means are engaged said panels are maintained in a substantially fixed orientation relative to one another;

(d) said locking means comprising an elongated recess defined in each of said first side panels, said recesses each being defined at opposite ends by opposed, inwardly directed ears, and said locking means comprising an elongated lobe with opposed outwardly directed ears, such that each of said lobes locks in the respective recess with the respective ears in the lock;

(e) said display being defined in its entirety from a single sheet of uniform thickness having linear folds between said side panels and front panels, and between said floor panels and the respective front and rear panels, said linear folds being comprised of die-cut score marks each cut with a rounded cross section to create a maximally durable hinge therealong;

(f) said side panels each having a foot defined in its lower region which extends behind said first panel to help support said display on an underlying horizontal surface to maintain said display in a free-standing mode each of said feet being a unitary part of the respective side panel to which it is a part, such that no bending is required to define said feet so that they are rigid, planar extensions of the respective side panels.

* * * * *